US005676077A

United States Patent [19]

Landoni

[11] Patent Number: 5,676,077

[45] Date of Patent: Oct. 14, 1997

[54] MULTI-NEEDLE CHAIN STITCH SEWING MACHINE WITH THREAD SEVERING SYSTEM

[76] Inventor: Giannino Landoni, Strada Prov. Busto/Cassano, 1-Fagnano Olona, Italy

[21] Appl. No.: 391,413

[22] Filed: Feb. 16, 1995

[51] Int. Cl.[6] ..... D05B 65/00; D05B 1/10

[52] U.S. Cl. ..... 112/475.01; 112/290; 112/295; 112/301; 112/166; 112/199

[58] Field of Search ..... 112/290, 293, 112/295, 301, 300, 165, 166, 197, 199, 475.01

[56] References Cited

U.S. PATENT DOCUMENTS

| | | | |
|---|---|---|---|
| 1,401,465 | 12/1921 | Devoe . | |
| 1,899,828 | 2/1933 | Rubel . | |
| 2,358,878 | 9/1944 | Pikul . | |
| 2,398,473 | 4/1946 | Stahl et al. | 112/290 X |
| 3,413,944 | 12/1968 | Spinrad et al. . | |
| 3,424,115 | 1/1969 | Schopf . | |
| 3,424,117 | 1/1969 | Schopf . | |
| 3,532,065 | 10/1970 | Marforio . | |
| 4,098,209 | 7/1978 | Schopf . | |
| 4,421,045 | 12/1983 | Portilla . | |
| 4,461,229 | 7/1984 | Angele et al. . | |
| 4,513,673 | 4/1985 | Brusasca et al. . | |
| 4,559,883 | 12/1985 | Lemke . | |
| 4,667,611 | 5/1987 | Yamamoto et al. . | |
| 4,683,828 | 8/1987 | Matsumoto . | |
| 4,726,305 | 2/1988 | Seto . | |
| 4,834,010 | 5/1989 | Choi et al. . | |
| 4,879,960 | 11/1989 | Prais . | |
| 4,886,005 | 12/1989 | Burton, Jr. | 112/301 X |
| 4,974,534 | 12/1990 | Eberhahn et al. . | |
| 5,009,177 | 4/1991 | Sato et al. . | |
| 5,125,351 | 6/1992 | Prais et al. | 112/292 |
| 5,138,961 | 8/1992 | Nakano et al. . | |
| 5,154,130 | 10/1992 | Gribetz et al. . | |
| 5,269,238 | 12/1993 | Landoni . | |

FOREIGN PATENT DOCUMENTS

| | | |
|---|---|---|
| WO-089/05369 | 6/1989 | WIPO . |

OTHER PUBLICATIONS

European Search Report No. EP 96 83 0065.

PFAFF® 3819 "Integrated Sewing Unit For Making Jeans Waistbands".

DCSP® System Meca "For Any Upholstery Sewing Stye".

*Primary Examiner*—Paul C. Lewis

*Attorney, Agent, or Firm*—Morgan & Finnegan

[57] ABSTRACT

A multi-needle chain stitch sewing machine with a thread thread severing system and method thereof for cutting needle threads between two isolated stitched patterns of a fabric. The multi-needle sewing machine includes a plurality of loopers and respective needles, a thread severing strip located in close proximity and transversely across each looper, and eccentric guides connected to the thread severing strip for extending the thread severing strip to cut the needle threads and for retracting the thread severing strip so that the thread severing strip does not contact the needle threads during the stitching operation. The method for sewing an array of isolated stitched patterns on a fabric including the steps of moving a plurality of loopers and respective needles to form an isolated stitched pattern; stopping the loopers after the needle thread is positioned around each looper; extending the thread severing strip, which is located in close proximity and transversely across each looper, in a direction toward the needle threads and in a side direction simultaneously such that the thread severing strip cuts the thread; and retracting the thread severing strip so as not to contact the needle thread during the stitch pattern forming operation.

20 Claims, 6 Drawing Sheets

MULTI-NEEDLE CHAIN STITCH SEWING MACHINE WITH THREAD SEVERING SYSTEM

FIELD OF THE INVENTION

This invention relates to a multi-needle sewing machine for sewing an array of isolated double chain stitched patterns on a fabric having a thread severing system which cuts the needle thread. This invention also relates to a sewing method to produce an array of isolated double chain stitched patterns on a fabric including the step of severing the needle thread so as to cut it.

BACKGROUND OF THE INVENTION

The multi-needle sewing machine and method of the present invention is used to form a double chain stitch. A double-chain stitch is well known in the art as a type 401 stitch. Generally, the double chain stitch is formed with two threads, one called the needle thread and the second thread called the looper thread.

Machines for sewing double chain stitches conventionally employ two basic elements to form a double chain stitch. The first element is a needle, which is usually located above the fabric as the fabric moves over a horizontally disposed needle plate and which cyclically reciprocates through the fabric. The needle thread passes through the needle and is carried by the needle through the fabric. The second element is conventionally referred to as a looper, which is located adjacent to each respective needle and which is located below the needle plate. The looper cyclically reciprocates in synchronism with the respective needle. The looper thread passes through the looper and is carried by the looper through the needle thread loop as the needle descends below the plate and through the fabric during each stitch cycle. As such, the double chain stitch is formed by passing the looper loop through the needle loop and then the needle loop through the looper loop.

The machines using a multi-needle system can use a plurality of needles and respective loopers and provide a wide sewing width. In such machines, however, the loopers move only backwards and forwards parallel to the direction of sewing and, since these machines can sew in any direction, the machines conventionally require the use of an extra element, a set of coaxially aligned spreaders or retainers to form the double chain stitch. The spreader or retainer, which moves horizontally in a cyclic motion in a plane below the needle plate and between the looper and the needle plate, spreads the looper thread to allow the descending needle with the corresponding needle thread to pass through a portion of the previous stitch to thereby form consecutive stitches.

It is known that multi-needle sewing machines and sewing methods using multi-needles can be used to sew various materials (for the sake of simplicity will be referred to collectively as fabric) including seams which consist mostly of an upper fabric, a lower fabric and a filler of cotton, foam or a similar material disposed therebetween and quilted fabrics which consist mostly of a cover, a liner and one or more fillers.

More specifically, it is known that multi-needle sewing machines can also perform the so-called "jumping with bar tack" pattern on a fabric where arrays of isolated chain stitched patterns are regularly repeated, such as, for example, the machine disclosed in U.S. Pat. No. 4,089,281. The stitched lines of these arrays of isolated stitched patterns are not continuous, but they start and stop at the beginning and the end of each pattern. For that purpose, the sewing machine is controlled in such a way that each needle, once the stitched pattern has been finished, jumps to the next position without performing any stitching, so that an empty area is left between a pair of adjacent patterns. In particular, a large share of the multi-needle sewing machines are presently of the electronically-controlled type, whereby they can be programmed to perform complicated stitching of a large variety of types.

A drawback of the known multi-needle sewing machines, however, is the fact that, between two isolated patterns which have been stitched by the same needle, there are left unsewn tension needle and looper threads connecting, in particular, the stitching end point of an isolated stitched pattern to the stitching start point of the other isolated pattern. Conventionally, these threads connecting the two isolated patterns have been manually removed. This manual operation, however, results in a great loss of time and a substantial increase in production costs of the final product after the arrays of isolated patterns have been formed.

Accordingly, there is a need for a thread cutting system that automatically cuts the needle thread prior to the formation of a new isolated pattern. However, because of the components, there is little space for positioning an automatic needle thread cutting system below the needle plate.

Several attempts have been made to automate the thread cutting system prior to the formation of a new isolated chain stitch pattern. For example, in U.S. Pat. No. 4,461,229, after the sewing operation is complete and the machine is stopped, a feeding roll is rotated so as to advance the fabric and to cause the needle thread to travel toward a cutting blade located on a stationary looper. Simultaneously, the fabric advancement pulls the looper thread into an inlet groove of a guide plate. A severing knife moves into the guide plate and the combination of the guide plate, which serves as a counter knife, and the severing knife act together to cut the looper thread. Since this approach, however, requires the fabric advancement to move the thread against the cutting blade, the tension on the thread is solely determined by the fabric advancement. As a result, the thread cut can be random, imprecise and discontinuous due to different tensions on different threads, due to different thicknesses of the quilted material and due to different elasticity of various threads.

Another attempt is described in U.S. Pat. No. 5,154,130 where a cutting edge is located on the retainer. The cutting occurs when the mechanism is disconnected from the timing during sewing, is reversed and thus, causes the cutting surface located on the retainer to contact the needle thread. Subsequently, the mechanism is stopped and the fabric is advanced to cause the needle thread to contact the cutting edge and thus, to cut the thread by friction. This approach, however, requires an additional time to cut the thread because the mechanism must be reversed prior to cutting the thread and then the mechanism must be synchronized prior to the start of the stitching operation. As a result, there is an increase in production costs due to the interruption in the sewing cycle to reverse the mechanism during the cutting operation and there can be an increase in maintenance problems due to reversing the mechanism.

SUMMARY OF THE INVENTION

In accordance with the invention, there is provided a multi-needle double chain stitch sewing machine with thread severing system comprising the steps of: (a) moving a plurality of needles provided with respective needle threads, a plurality of loopers and the fabric and forming a plurality of isolated double chain stitch patterns, the loopers being located below a needle plate, the fabric being located above the needle plate and each looper of the plurality of loopers being positioned adjacent to a respective needle; (b) stopping the loopers after forming the isolated patterns and after the needle thread is positioned around each looper; (c) extending a thread severing means, the thread severing means positioned below the needle plate and in close proximity thereto and above the plurality of loopers and located transversely across the loopers, and cutting the needle thread of each looper with the thread severing means; (d) retracting the thread severing means so that the thread severing means is not contacting the needle thread during the formation of the chain stitch pattern; and (e) resuming the double chain stitch pattern and forming a second chain stitch pattern.

In another aspect of the invention, there is provided a thread thread severing system for a multi-needle sewing machine comprising: (a) a needle plate, a plurality of sets of respective needles and loopers, each needle being located above the needle plate and carrying a needle thread, each looper being located below the needle plate and each looper of the plurality of loopers being positioned adjacent to a respective needle; (b) a thread severing means for cutting each needle thread, the thread severing means located below the needle plate in close proximity to and above each looper and in close proximity to each needle thread, which being positioned around each looper, the thread severing means extended transversely across the loopers; and (c) an actuating means, connected to respective ends of the thread severing means for extending the thread severing means so that the thread severing means contacts and cuts each needle thread and for subsequently retracting the thread severing means so that the thread severing means does not contact each needle thread during sewing of the fabric.

DESCRIPTION OF THE INVENTION

Figure 1:
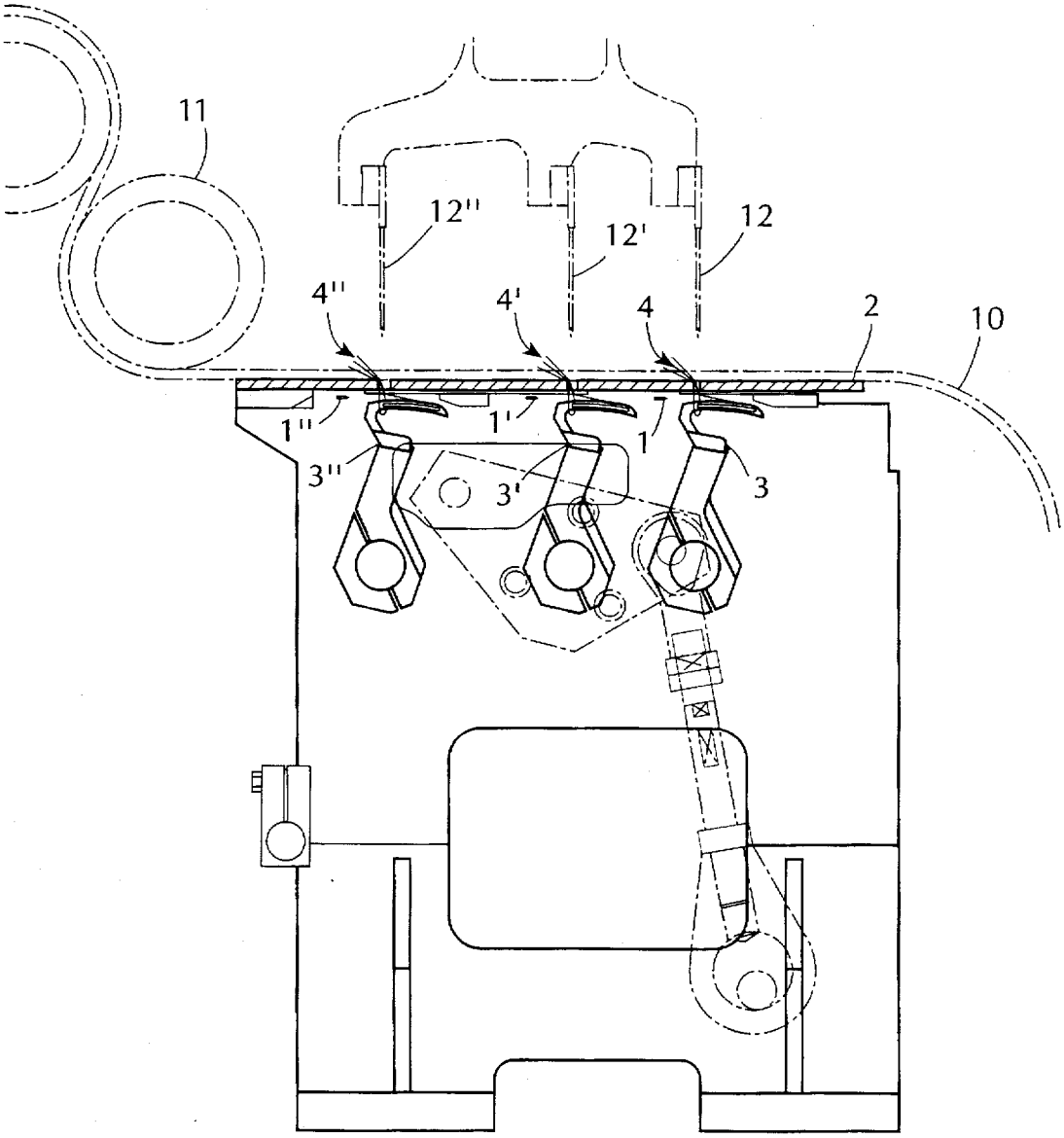
FIG. 1 is a partially schematic side elevational view of a portion of a sewing machine in accordance with this invention showing three needles and respective loopers and the position of the thread severing system during the stitch pattern forming operation.

Referring to FIG. 1, an embodiment of the sewing machine according to this invention is shown to include three rows of loopers 3, 3', 3", only the first looper of each row is visible in this figure. Above the three rows of loopers, suitable feeding rolls 11 cause a sliding motion of the fabric 10, which is operated upon by means of three rows of needles 12, 12', 12", each of which is positioned at respective loopers 3, 3', 3". During the stitching step shown in FIG. 1, needle threads 4, 4', 4" are positioned around the respective loopers 3, 3', 3". Also during the stitching step shown in FIG. 1, a thread severing means 1, 1', 1", which is located below the needle plate 2 and in close proximity above the respective loopers 3, 3', 3" and in close proximity to the respective needle threads 4, 4', 4", is kept in a position so as not to contact the respective needle threads 4, 4', 4" during the stitching operation. During the stitching operation, all the loopers of the machine are subjected to an oscillating movement and, in combination with the movement of the corresponding needles, the loopers and respective needles perform the double chain stitching used for sewing fabric.

In a preferred embodiment, when the stitching operation is complete (i.e., the multi-needle sewing machine has finished its sewing and bar tack operation) and thus, when the isolated patterns are formed, the multi-needle sewing machine stops the fabric movement and stops needles 4, 4', 4" in a raised position relative to fabric 10, and with the respective needle threads 4, 4', 4" loaded on corresponding loopers 3, 3', 3". Subsequently, the jump sequence occurs whereby the fabric 10 is advanced a predetermined distance by feeding rolls 11 through a span whose length may be varied in order to control the length of the portion of needle threads 4, 4', 4". Simultaneously, the needle threads 4, 4', 4", that were substantially braked during the stitching operation, are left free so to allow the needle threads 4, 4', 4", which are positioned around the respective loopers 3, 3', 3", to move in place. Suitable methods to apply tension to the needle thread include needle thread tensioners (not shown).

Figure 3:
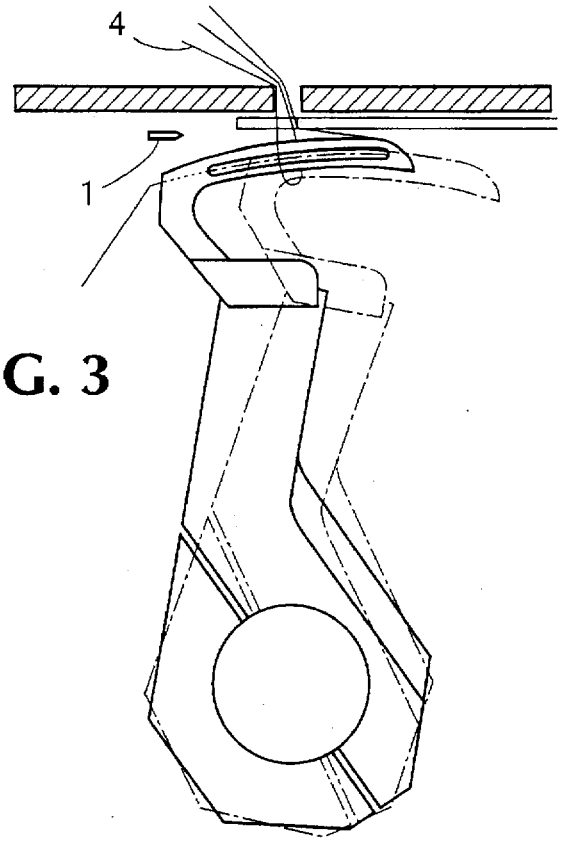
FIGS. 3–5 are partially schematic, side elevational views of a single thread severing strip and looper of FIG. 1, where the thread severing strip is shown at different positions during the stitch pattern forming and cutting operations according to this invention.
Figure 4:
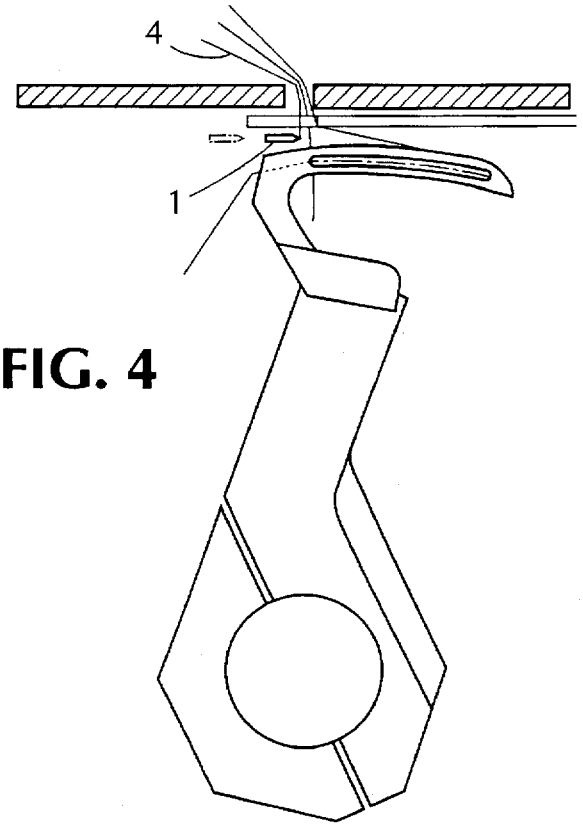
Figure 5:
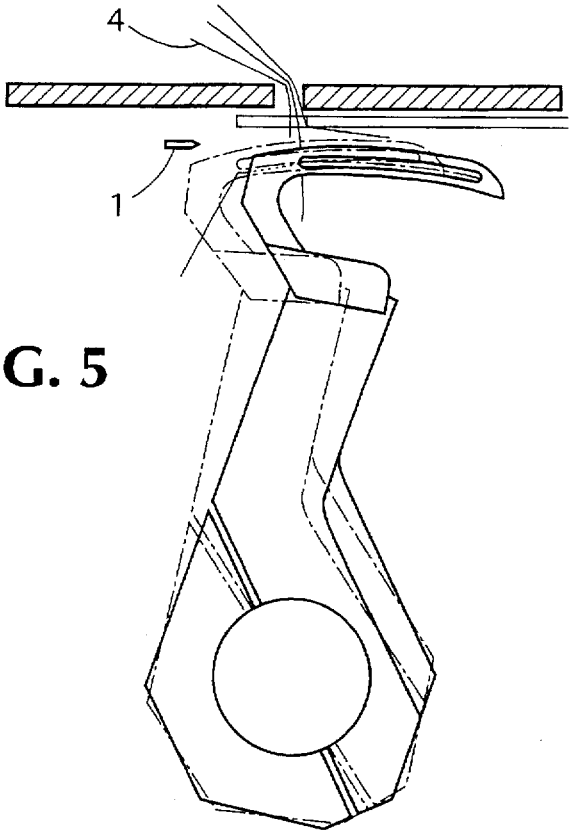
Figure 6:
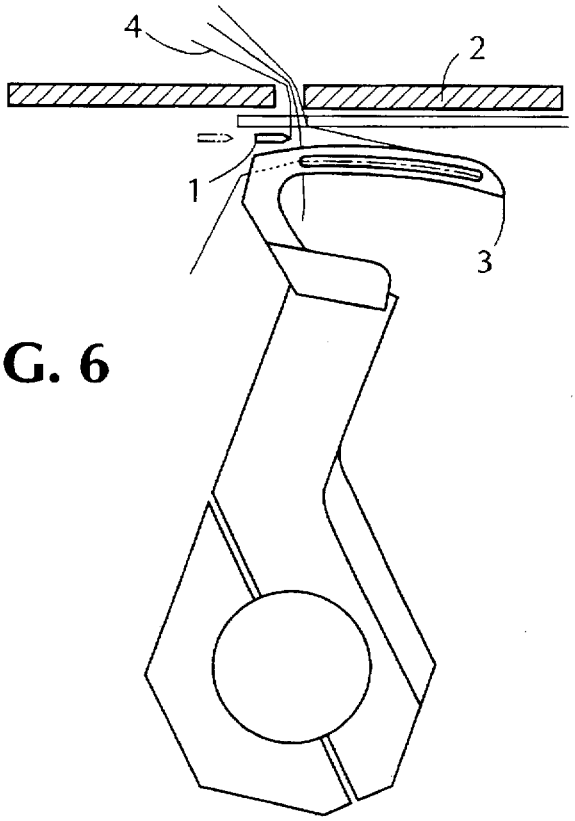
FIG. 6 is a partially schematic, side elevational view of a single thread severing strip and looper of FIG. 3 according to this invention.

The subsequent thread cutting sequence is illustrated in FIGS. 3–5. FIG. B shows the position of the thread severing means 1 during the stitching operation. FIG. 4 shows the position of the thread severing means 1 during the thread cutting operation. As shown in FIG. 4, after the fabric advancement is stopped by stopping the feed rolls and after needle thread 4 have been locked, the thread severing means 1 is extended in such a way as to bring the thread severing means 1 in contact with the needle thread 4 so as to cut the needle thread 4. After the needle thread 4 is cut, the thread severing means 1 is retracted to its original position as shown in FIG. 5. The normal stitching cycle is resumed, including, as shown in FIG. 1, for example, advancing the fabric 10 by the movement of the feed rolls 11 to a selected position adjacent the starting point of a new isolated chain stitch pattern.

Figure 2A:
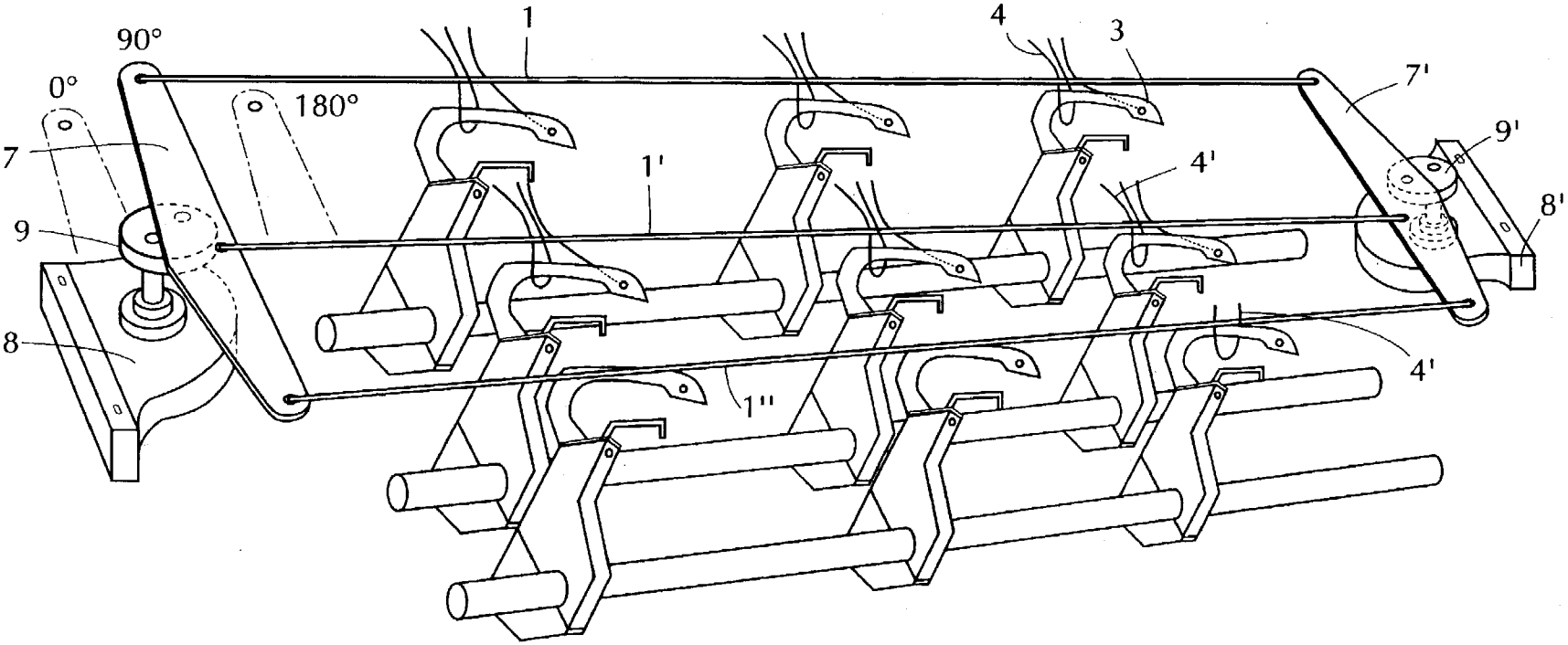
FIG. 2A is a partially schematic, perspective views of three rows of loopers, each row having three loopers shown and showing an embodiment of the thread severing system according to this invention.

As further shown in FIG. 2A, the thread severing means 1, 1', 1" is located transversely across the plurality of loopers. In a preferred embodiment, the extending and retracting of the thread severing means 1, 1', 1" is preferably achieved by an actuating means, which includes both elements 7, 8 and 9 as shown in FIG. 2A. Guides 7, 7' are connected to ends of the thread severing means and, typically, disposed perpendicular to the ends. The actuating means 7 and 7', 8 and 8', 9 and 9' operate to extend the thread severing means 1, 1', 1" so that the thread severing means 1, 1', 1" contacts and cuts the thread during the thread cutting operation and to retract the thread severing means 1, 1', 1" during the stitching operation. In an embodiment, as illustrated in FIG. 2A, the actuating means may include guides 7, 7' for extending and retracting the thread severing means 1. The guides 7, 7' may be attached to pneumatic rotating actuators 8, 8' by way of eccentrics 9, 9'

Accordingly, during the stitching operation, the thread severing means 1, 1', 1" are not contacting the needle threads 4. In contrast, during the thread cutting operation, pneumatic actuators 8, 8', which are shown in FIG. 2A, are actuated in such a way that eccentrics 9, 9' rotate guides 7, 7' and thus, guides 7,7' are brought to the maximum extension positions whereby thread severing means 1 contacts the needle thread 4, 4', 4" to thereby cut the needle thread. Subsequently, the pneumatic actuators 8, 8' are actuated in such a way that eccentrics 9, 9' rotate to retract the guides 7, 7' respectively to the minimum extension. Accordingly, the thread severing means 1 is brought back to its original position during the stitching operation.

In another embodiment, three sets of thread severing strips, 1, 1', 1" extend transversely across the three rows of a loopers wherein each row has a plurality of loopers. As an example, during the thread cutting operation, the three thread severing strips 1, 1', 1" are extended 21 mm from their original position during the stitching operation to cut the needle thread by extending the guides 7, 7'.

In a more preferred embodiment, as shown in FIG. 2A, the thread severing means 1, 1', 1" is a thread severing strip. The shape of the thread severing strip may consist of a cylinder with varying diameters, a strap with varying width or a strip with varying width. The thread severing strip may be composed of hardened steel or other suitable material that can sever thread. In a preferred embodiment, the thread severing strip has dimensions of about 3 mm wide by about 0.5 to 0.8 mm thick. The thread severing strip may be replaced by any known device, suitable for thread severing the thread according to the ways described herein above.

Figure 2B:
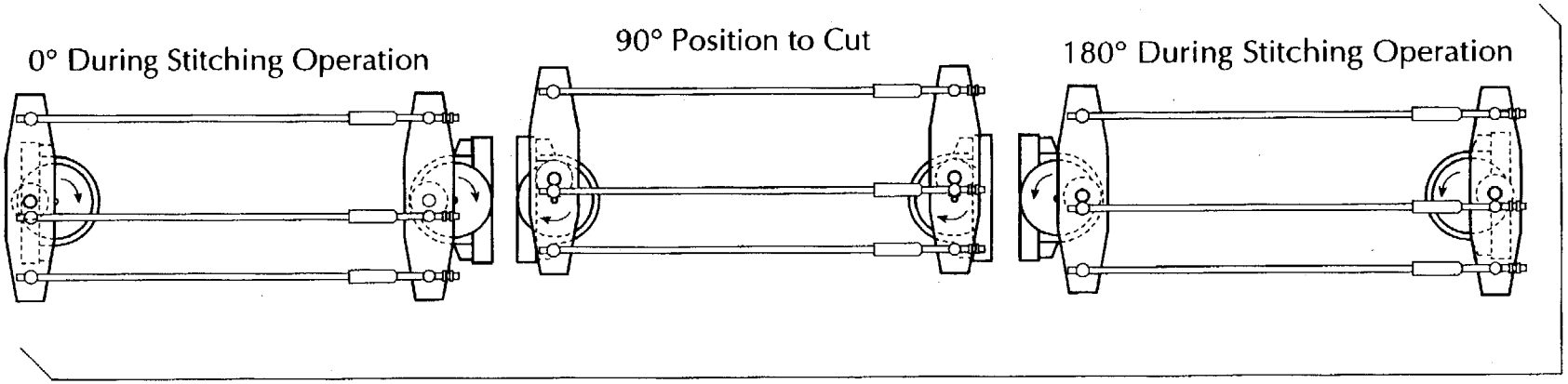
FIGS. 2B and 2C are partially schematic, top views of three thread severing strips and illustrating the extending and retracting motion of the thread severing system of FIG. 2A.
Figure 2C:
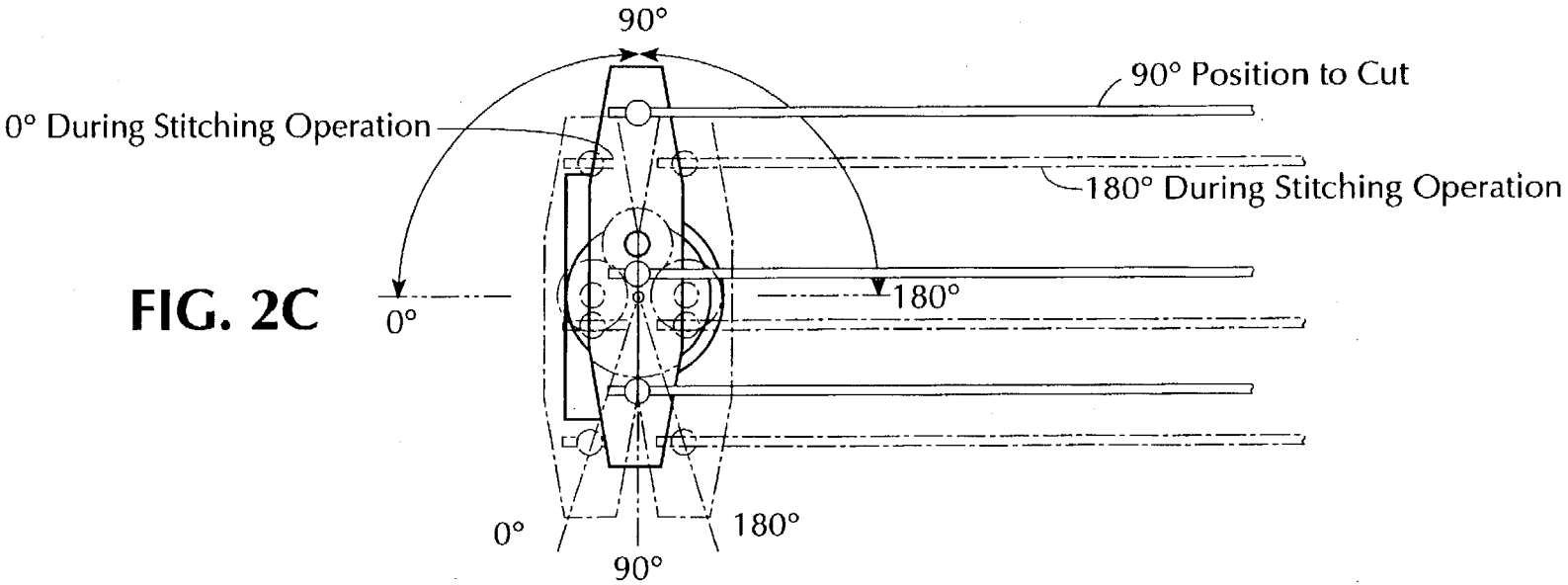

In a preferred embodiment, as shown in FIGS. 2A and 2B, the actuating means includes pneumatic actuators 8, 8' eccentrics 9, 9' and guides 7, 7'. Specifically, on pneumatic actuators 8, 8', there are mounted eccentric guides 7, 7' integral with the pneumatic actuators 8, 8' which drive guides 7, 7'. The eccentric guides 7, 7' are connected to ends of the thread severing means 1, 1', 1". FIG. 2B shows the position of the thread severing means 1, 1', 1" during the stitching operations and the position of the thread severing means 1, 1', 1" directly after the thread is cut.

The following is a preferred embodiment of this invention. For purposes of the following description, the position of guides 7, 7' during the first stitching operation is taken as zero degree. At the 0° position of the eccentric guides 7, 7', the thread severing means 1, 1', 1" are not contacting the needle thread during the stitch pattern forming operation. Referring to FIG. 2A, after forming the isolated stitched pattern, the plurality of loopers are stopped with the needle thread (illustrated by element 4) positioned around each looper. After the fabric advancement operation is complete including re-applying tension to the threads, the thread cutting operation begins. Referring to FIG. 2B, the clockwise rotation of the pneumatic actuator 8 causes the eccentric 9 and thus, the eccentric guide 7 to begin to rotate in an elliptical clockwise rotation in a horizontal plane, which in turn, begins to move the thread severing means 1, 1', 1" in a direction toward the needle threads and in a side direction simultaneously. The motion of the eccentric guide 7, represented by FIG. 2B by the arrows, brings the eccentric guide 7 to the position at 90° point in its cycle. At this point, the thread severing means 1, 1', 1" has advanced 21 mm to a position where the thread severing means 1, 1', 1" has already contacted and cut the needle thread by, essentially, a sawing action of the thread severing means on the needle thread. The motion of pneumatic actuator 8 continues, which, in turn, continues the rotation of eccentric 9, and thus, continues the elliptical clockwise rotation of the eccentric guide 7 to a position at 180° point in the eccentric guide 7 cycle. At this point, the motion of the pneumatic actuator 8 stops, which in turn, stops the rotation of the eccentric 9 and thus, the rotation of the eccentric guide 7. The result is that the thread severing means 1, 1', 1" is again at the same position where it was located during the previous stitch pattern forming operation. The sewing machine is again ready to resume a second stitch pattern forming operation.

During the second stitching pattern forming operation, the position of eccentric guide 7 is taken as 180° position. At the 180° position of the eccentric guide 7, the thread severing means 1, 1', 1" is not contacting the needle thread. Referring again to FIG. 2A, after forming a second isolated stitch pattern, the plurality of loopers are stopped with the needle thread (illustrated by element 4) positioned around each looper. After the fabric advancement operation is complete including re-applying tension to the threads, the second thread cutting operation begins. Referring to FIG. 2B, the clockwise rotation of the pneumatic actuator 8 causes the eccentric 9 and thus, eccentric guide 7 to begin to rotate in an elliptical clockwise rotation in a horizontal plane, which in turn, begins to move the thread severing means 1, 1', 1" in a direction toward the needle threads and in a side direction simultaneously. The motion of the eccentric guide 7, represented by FIG. 2B by the arrows, brings the eccentric guide 7 to the position at 90° point in its cycle. At this point, the thread severing means 1, 1', 1" has advanced to a 21 mm position where the thread severing means 1, 1', 1" has already contacted and cut the needle thread by, essentially, a sawing action of the thread severing means on the needle thread. The motion of pneumatic actuator 8 continues, which, in turn, continues the rotation of the eccentric guide 7 to the position at approximately 0° point in the eccentric guide 7 cycle. At this point, the motion of the pneumatic actuator 8 stops, which, in turn, stops the rotation of eccentric 9 and thus, the rotation of the eccentric guide 7. The result is that the thread severing means 1, 1', 1" is again at the same position where it was located during the previous stitch pattern forming operation. The sewing machine is again ready to resume another stitch pattern forming operation. As can be determined from FIG. 2B and the discussion above, additional thread cutting and stitch pattern forming operations repeat the same cycles as described above. The motion of the eccentric guide, which is described above, may be varied by any other known method suitable for producing a similar cutting action.

As can also be determined from FIG. 2B and the discussion above, the thread severing means 1, 1', 1" motion during each cutting operation repeatedly alternates from a motion essentially of towards the needle thread and in a side direction simultaneously to a motion toward the needle thread and in the opposite side direction simultaneously along a horizontal plane. Accordingly, since the thread severing means 1, 1', 1" operates in both left and right side direction, this allows the eccentric guide to rotate in only 180° cycle to complete the thread cutting operation and to resume the stitching operation. Thus, the present invention can complete the sequence of operations quickly and efficiently and therefore, without much interruption on the production times.

It is understood that the pneumatic actuators may be replaced by any known device, suitable for moving guides according to the ways described herein above, while all the mechanical components mentioned above may be of any other type suitable for their purpose.

Figure 7:
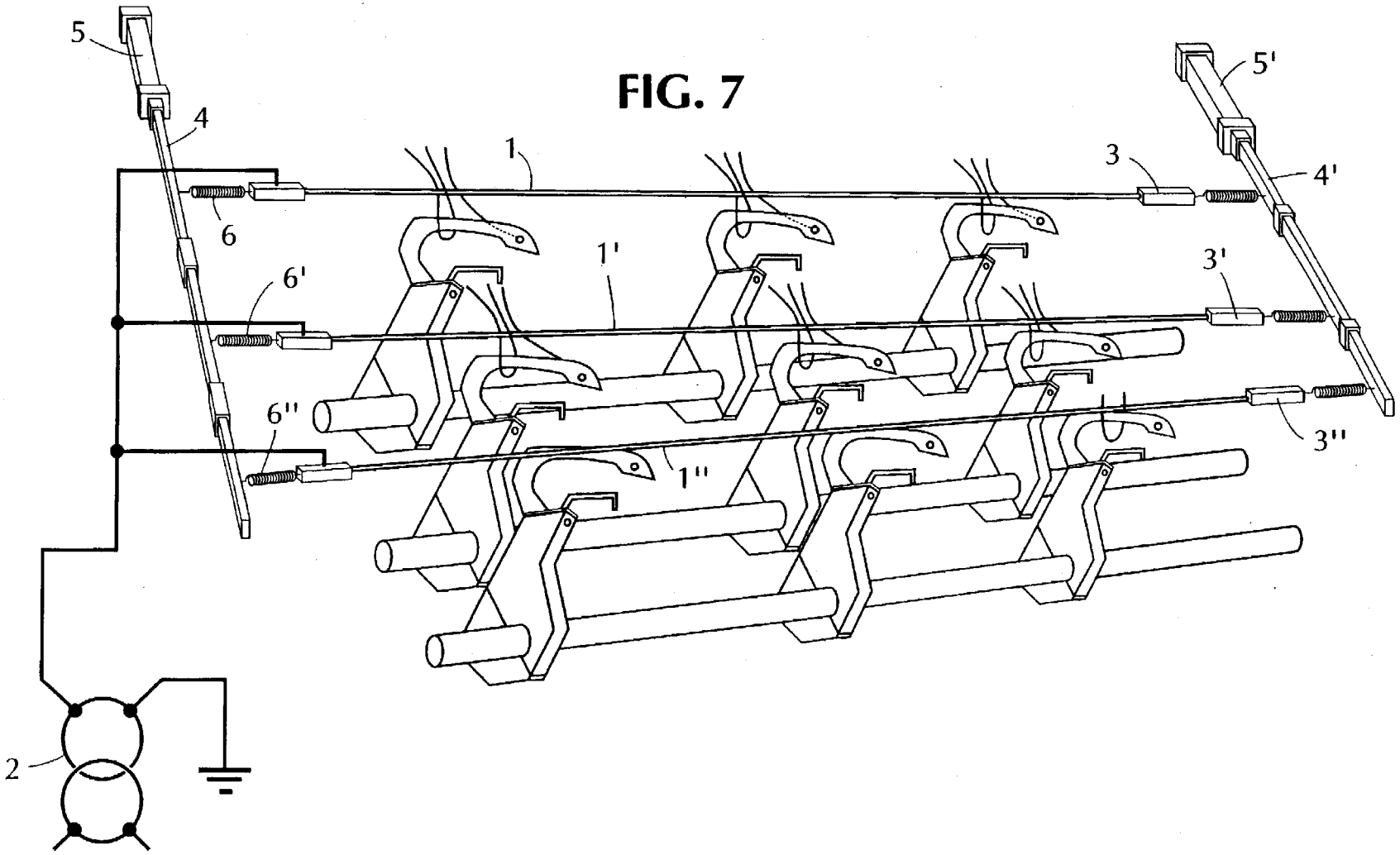
FIG. 7 is a partially schematic, perspective view of three rows of loopers, each row having three loopers shown and showing an embodiment of the thread severing means as a heated wire according to this invention.

In a further embodiment, as shown in FIG. 7, the thread severing means is a heated wire 1, $1^{1}$ and $1^{11}$. The shape of the wire may consist of a cylinder with varying diameters, a flat strap with varying width or other suitable shapes. The wire may be composed of steel, or other suitable materials that can be heated when electricity is supplied. In another embodiment, the wire is in the range of about 0.36 mm diameter and is composed of steel. It is understood that the wire may be replaced by any known device, suitable for heating the thread according to the ways described herein above. It is preferred that the heated wire 1, $1^1$ and $1^{11}$ is heated by supplying electricity 2 through electricity supply cables connected to the wire. The electricity may be a high frequency, low voltage supplied by a transformer. A preferred temperature of the heated curing means 1, $1^1$ and $1^{11}$ is in the range of 170° to 195° F. but, it is well understood, that the optimum temperature will vary depending on the conditions including the composition of the thread and the composition of the wire. It is also understood that other suitable methods of heating may be used according to the ways described herein above. Additionally, in another embodiment, the actuating means is connected to the heated wire 1, $1^1$ and $1^{11}$ by at least one insulating block 3, $3^1$ and $3^{11}$, wherein a first end of the insulating block is engaged to an end of the heated wire and a second end of the insulating block is attached to the actuating means 4, $4^1$, 5 and $5^1$. In a further embodiment, the connecting means further includes a tension means 6, $6^1$ and $6^{11}$ that is disposed between the insulating block and the actuating means. The tension means operates to maintain a uniform tension on the heated cutting means during both the heat-up and cool-down sequence of the heated cutting means, i.e. to compensate for thermal elongation of the heated wire. Suitable tension means include springs.

It should be noted that, when using the multi-needle sewing machine according to this invention, in addition to doing completely away with the manual thread cutting step, it is possible to program the automatic cutting of said thread in such a way that the final look is improved. In fact, by advancing fabric 10 a predetermined distance in the step ahead of the thread cutting operation, i.e. the jump sequence, "thread tails" are obtained (i.e. lengths of thread going from the cutting point to the needles eye) long enough to make it possible to resume normally the stitching operation after the cutting operation, but short enough to prevent the cut end of the needle thread to be left outside the surface of the fabric once the stitching has been resumed. It should eventually be noted that the subject machine can go through the sequence of operations necessary for the thread cutting cycle within a few seconds, therefore without any substantial influence on the production times.

Therefore, the above and further modifications may be made by those skilled in this art to the sewing machine according to this invention without exceeding the scope of protection of this invention as defined in the appended claims.

I claim:

1. A method for sewing an array of isolated stitched patterns on a fabric comprising the steps of:

(a) moving a plurality of needles provided with respective needle threads, a plurality of loopers and the fabric and forming a plurality of isolated double chain stitch patterns, the loopers being located below a needle plate, the fabric being located above the needle plate and each looper of the plurality of loopers being positioned adjacent to a respective needle;

(b) stopping the loopers and needles after forming the isolated pattern and after the needle thread is positioned around each looper;

(c) extending a thread severing strip while the loopers and needles are stationary, the thread severing strip located below the needle plate in close proximity and above the plurality of loopers and located transversely across the loopers, and cutting the needle thread of each looper with the thread severing strip;

(d) retracting the thread severing strip so that the thread severing strip is not contacting the needle thread during the formation of the chain stitch pattern; and (e) resuming the movement of the needles and loopers so as to resume the formation of the double chain stitch pattern and forming a second chain stitch pattern.

2. The method of claim 1 further comprising the step of: after stopping the loopers in step (b), advancing the fabric a predetermined distance relative to the loopers and needles.

3. The method of claim 2 further comprising the step of: after advancing the fabric a predetermined distance relative to the looper and needles, stopping the fabric advancement.

4. The method of claim 2 further comprising the step of: after retracting the thread severing strip in step (d), advancing the fabric to a new starting position.

5. The method of claim 4 wherein the extending of the thread severing strip in step (c) is in a direction toward the needle thread and in a side direction, such that the thread severing strip contacts and cuts the thread in a sawing action.

6. The multi-needle sewing machine for double chain stitch sewing an array of isolated chain stitch patterns on a fabric comprising:

(a) a needle plate, a plurality of sets of respective needles and loopers, each needle is located above the needle plate and carries a needle thread, each looper is located below the needle plate;

(b) a thread severing strip having at least two respective ends for cutting each needle thread, the thread severing strip is located below the needle plate in close proximity above the plurality of loopers and in close proximity to each needle thread, which is positioned around each looper, the thread severing strip located transversely across the loopers; and (c) at least one eccentric guide connected to respective ends of the thread severing strip for extending the thread severing strip toward the needle threads and in a side direction such that the thread severing strip contacts and cuts the threads in a sawing action, and for subsequently retracting the thread severing strip.

7. The multi-needle sewing machine according to claim 6 further comprising at least one pneumatic actuator axially attached to the eccentric guide for extending and retracting the guides.

8. The multi-needle sewing machine according to claim 7 further comprising an eccentric mounted on the pneumatic actuator to produce an elliptical rotation of the eccentric.

9. A multi-needle sewing machine for double chain stitch sewing an array of isolated chain stitch patterns on a fabric comprising:

(a) a needle plate, a plurality of sets of respective needles and loopeers, each needle is located above the needle plate and carries a needle thread, each looper is located below the needle plate;

(b) a wire for heating each needle thread so as to cut each needle thread, the wire is located below the needle plate in close proximity above the plurality of loopers and in close proximity to a plurality of needle threads, which are positioned around each looper, the wire extends transversely across the plurality of loopers; and (c) at least one parallel slidable guide for extending and for retracting the wire, the slidable guide connected to the wire by a spring and an insulating block, wherein the spring is disposed between the insulating block and the slidable guide and wherein a first end of the insulating block is engaged to an end of the wire and a second end of the insulating block is attached to the spring.

10. A multi-needle sewing machine for double chain stitch sewing and forming an array of isolated chain stitched patterns on a fabric comprising:

(a) a needle plate, a plurality of sets of respective needles and loopers, each needle being located above the needle plate and carrying a needle thread, each looper being located below the needle plate and each looper of the plurality of loopers being positioned adjacent to a respective needle;

(b) a heated wire for cutting each needle thread, the heated wire located below the needle plate in close proximity to and above each looper and in close proximity to each needle thread, which being positioned around each looper, the heated wire located transversely across the loopers; and (c) an actuating means connected to respective ends of the heated wire for extending the heated wire to contact and to cut each needle thread, and for subsequently retracting the heated wire so that the heated wire does not contact each needle thread during sewing of the fabric.

11. The multi-needle sewing machine according to claim 10 wherein the actuating means includes guides for extending and for retracting the thread severing means and at least one pneumatic actuator attached to the guides.

12. A method for sewing an array of isolated stitched patterns on a fabric comprising the steps of:

(a) moving a plurality of needles provided with respective needle threads, a plurality of loopers and the fabric and forming a plurality of isolated double chain stitch patterns, the loopers being located below a needle plate, the fabric being located above the needle plate and each looper of the plurality of loopers being positioned adjacent to a respective needle;

(b) stopping the needles and loopers after forming the isolated pattern and after the needle thread is positioned around each looper;

(c) elliptically rotating a thread severing means toward the needle threads while the needles and loopers are stationary; the thread severing means located below the needle plate in close proximity and above the plurality of loopers and located transversely across the loopers;

(d) sawing the thread until the thread is cut;

(e) retracting the thread severing means so that the thread severing means is not contacting the needle thread during the formation of the chain stitch pattern; and (f) resuming the movement of the needles and loopers so as to resume the formation of the double chain stitch pattern and forming a second chain stitch pattern.

13. The method of claim 12 further comprising the step of:

after stopping the loopers in step (b), advancing the fabric a predetermined distance relative to the loopers and needles.

14. The method of claim 13 further comprising the step of:

after advancing the fabric a predetermined distance relative to the loopers and needles, stopping the fabric advancement.

15. The method of claim 13 further comprising the step of:

after retracting the thread severing means in a step (e), advancing the fabric to a new position.

16. The method of claim 12 wherein the thread severing means is a thread severing strip.

17. The method of claim 12 wherein the elliptical rotation of step (c) is produced by at least one eccentric guide connected to the thread severing means.

18. The multi-needle sewing machine for double chain stitch sewing an array of isolated chain stitch patterns on a fabric comprising:

(a) a needle plate, a plurality of sets of respective needles and loopers, each needle is located above the needle plate and carries a needle thread, each looper is located below the needle plate;

(b) a thread severing strip for cutting each needle thread, the thread severing strip is located below the needle plate in close proximity above the plurality of loopers and in close proximity to each needle thread, which is positioned around each looper, the thread severing strip located transversely across the loopers;

(c) at least one guide for extending the thread severing strip toward the needle threads and in a side direction essentially simultaneously such that the thread severing strip contacts and cuts the threads in a sawing action, and for subsequently retracting the thread severing strip; and (d) at least one pneumatic actuator axially attached to the thread severing strip for extending the thread severing strip toward the needle thread and in a side direction essentially simultaneously.

19. A method for sewing an array of isolated stitched patterns on a fabric comprising the steps of:

(a) moving a plurality of needles provided with needle threads in combination with a plurality of loopers and the fabric, the loopers being located below a needle plate and each looper being positioned adjacent to a respective needle;

(b) stopping the loopers with needle thread positioned around each looper after forming the isolated patterns;

(c) advancing the fabric a predetermined distance relative to the loopers and needles;

(d) stopping the fabric advancement;

(e) supplying heat to a wire, which is below the needle plate and in close proximity above the loopers;

(f) positioning a wire, so that the wire contacts the needle thread of each looper;

(g) applying a sufficient heat through the wire to the needle thread so as to cut the needle thread;

(h) retracting the wire so as not to contact the needle thread during the stitch pattern forming operation;

(i) advancing the fabric to a new starting position; and (j) resuming the double chain stitch pattern forming operation to form a second isolated chain stitch pattern.

20. A multi-needle sewing machine for double chain stitch sewing an array of isolated chain stitch patterns on a fabric comprising:

(a) a needle plate, a plurality of sets of respective needles and loopers, each needle is located above the needle plate and carries a needle thread, each looper is located below the needle plate;

(b) a wire for heating each needle thread so as to cut each needle thread, the wire is located below the needle plate in close proximity above the plurality of loopers and in close proximity to a plurality of needle threads, which are positioned around each looper, the wire extends transversely across the plurality of loopers; and (c) at least one parallel slidable guide for extending and for retracting the wire, the slidable guide connected to an end of the wire.

* * * * *